US009737783B2

(12) United States Patent
Doerr

(10) Patent No.: US 9,737,783 B2
(45) Date of Patent: Aug. 22, 2017

(54) FREE WEIGHT ORGANIZATION SYSTEM

(71) Applicant: Daniel Doerr, Salt Lake City, UT (US)

(72) Inventor: Daniel Doerr, Salt Lake City, UT (US)

( * ) Notice: Subject to any disclaimer, the term of this patent is extended or adjusted under 35 U.S.C. 154(b) by 0 days.

(21) Appl. No.: 14/645,082

(22) Filed: Mar. 11, 2015

(65) Prior Publication Data

US 2015/0258412 A1 Sep. 17, 2015

Related U.S. Application Data

(60) Provisional application No. 61/951,864, filed on Mar. 12, 2014.

(51) Int. Cl.

| | |
|---|---|
| ***A63B 21/06*** | (2006.01) |
| ***A63B 21/072*** | (2006.01) |
| ***A63B 71/00*** | (2006.01) |
| ***A63B 21/00*** | (2006.01) |
| ***A63B 21/078*** | (2006.01) |

(52) U.S. Cl.

CPC .... *A63B 71/0036* (2013.01); *A63B 21/00065* (2013.01); *A63B 21/072* (2013.01); *A63B 21/078* (2013.01)

(58) Field of Classification Search

CPC . A63B 21/4035; A63B 21/078; A63B 21/072; A63B 21/00065; A63B 21/063; A63B 21/0724; A63B 21/075; A63B 23/12; A63B 21/06; A63B 21/0726; A63B 21/00069; A63B 71/0036; A47B 49/00

USPC ..... 482/92–94, 97–98, 101, 104, 148; D6/552; D21/691; 248/415

See application file for complete search history.

(56) References Cited

U.S. PATENT DOCUMENTS

| | | | | | |
|---|---|---|---|---|---|
| 1,490,650 | A * | 4/1924 | Wagner | A47G 7/041 | 248/170 |
| 3,421,762 | A * | 1/1969 | Paradise | A63F 9/0208 | 211/107 |
| 3,771,785 | A * | 11/1973 | Speyer | A63B 21/0728 | 403/104 |
| 4,527,797 | A * | 7/1985 | Slade, Jr. | A63B 21/078 | 482/101 |
| 4,889,246 | A * | 12/1989 | Lee | A47F 5/02 | 211/163 |
| 5,137,502 | A * | 8/1992 | Anastasi | A63B 21/072 | 482/105 |
| D394,685 | S * | 5/1998 | Eckmann | D21/680 | |
| D450,474 | S * | 11/2001 | Sokoloff | D6/681.3 | |
| 6,406,409 | B1 | 6/2002 | Silver | | |
| 6,436,015 | B1 * | 8/2002 | Frasco | A63B 21/072 | 482/106 |
| D468,946 | S * | 1/2003 | Harms | D21/691 | |

(Continued)

*Primary Examiner* — Andrew S Lo

(74) *Attorney, Agent, or Firm* — Durham Jones & Pinegar; Randall B. Bateman; Tenley H. Schofield

(57) ABSTRACT

A free weight organization system is described that prevents misplacement of the free weight plates on the weight rack. The system includes weight plates with recesses and keyed weight rack posts with corresponding projections. The placement of the recesses varies from one size of weight plate to another, preventing a weight plate of the wrong sized being placed on a rack post of the weight rack. The weight plates may also include a loading rest recess, with the keyed rack posts having a loading rest rod to assist in the correct placement of the plates on the rack.

25 Claims, 15 Drawing Sheets

(56) References Cited

U.S. PATENT DOCUMENTS 6,550,155 B1 * 4/2003 Hsu ..... G01B 3/1005 242/395
6,629,910 B1 * 10/2003 Krull ..... A63B 21/0628 482/107
6,702,723 B2 * 3/2004 Landfair ..... A63B 21/06 482/106
6,746,380 B2 * 6/2004 Lien ..... A63B 21/06 482/106
6,872,173 B2 * 3/2005 Krull ..... A63B 21/0728 482/107
6,974,039 B2 12/2005 Comartin et al.
7,087,000 B1 * 8/2006 Walker ..... A63B 21/0728 482/106
7,112,164 B1 * 9/2006 Hoagland ..... A63B 21/0724 482/106
7,198,591 B2 * 4/2007 Lien ..... A63B 21/0728 482/106
7,476,183 B1 * 1/2009 Chrest ..... A63B 21/072 482/908
7,625,322 B1 12/2009 Krull
7,828,702 B2 * 11/2010 Lien ..... A63B 21/0724 482/106
8,075,458 B2 * 12/2011 Nalley ..... A63B 21/0615 482/94
8,485,946 B2 7/2013 Ross et al.
8,585,563 B2 * 11/2013 Wilson ..... A63B 21/0004 482/106
8,998,778 B2 * 4/2015 Potts ..... A63B 21/0724 482/104
9,375,626 B2 * 6/2016 English ..... A63B 71/0036
2001/0049324 A1 * 12/2001 Wallace ..... A63B 21/072 482/106
2003/0232704 A1 * 12/2003 Bowman ..... A63B 21/0728 482/107
2004/0005968 A1 * 1/2004 Crawford ..... A63B 21/0607 482/106
2004/0140277 A1 * 7/2004 Comartin ..... A63B 71/0036 211/59.1
2004/0220025 A1 * 11/2004 Krull ..... A63B 21/0728 482/94
2006/0003874 A1 * 1/2006 Hamilton ..... A63B 21/06 482/93
2009/0298654 A1 * 12/2009 Dickerson ..... A63B 21/075 482/93
2010/0075816 A1 * 3/2010 Anderson ..... A63B 21/0728 482/107
2010/0179032 A1 * 7/2010 Perry ..... A63B 71/0036 482/94
2010/0179033 A1 * 7/2010 Perry ..... A63B 71/0036 482/104
2010/0285933 A1 * 11/2010 Nalley ..... A63B 21/0615 482/94
2012/0283071 A1 * 11/2012 Nalley ..... A63B 21/063 482/93
2013/0217548 A1 * 8/2013 Muehl ..... A63B 21/062 482/98
2013/0231225 A1 * 9/2013 Shozda ..... A63B 21/0724 482/108
2013/0244841 A1 * 9/2013 Anderson ..... A63B 21/062 482/98
2014/0162855 A1 * 6/2014 Beckman ..... A63B 21/0728 482/139
2015/0258412 A1 * 9/2015 Doerr ..... A63B 71/0036 482/93
2015/0321044 A1 * 11/2015 English ..... A63B 21/072 248/415
2015/0367163 A1 * 12/2015 Moran ..... A63B 21/075 482/108
2016/0101312 A1 * 4/2016 Yusufov ..... A63B 21/072 482/106

* cited by examiner

DISTANCES MAY VARY
FOR LOADING REST AND
NOTCH TO REATE VARIATIONS
TO THE CONCEPT.
(ALT. SHAPE COULD ALSO BE USED)...

SECTION A-A

FREE WEIGHT ORGANIZATION SYSTEM

FIELD OF THE INVENTION

The present invention relates generally to the field of weight lifting, and more particularly to a system for managing free weights. More specifically, the present invention relates to an improved system for keeping free weights of different sizes organized separately on a weight rack.

BACKGROUND

Lifting weights is often done by the use of free weight plates (often called Olympic weight plates) in conjunction with different types of exercise equipment, such as a free weight bar. Free weight plates allow the user to vary the amount of weight used for different exercises. The free weight plates typically come in weights of 2.5, 5, 10, 25, 35 and 45 lbs. Standard weight plates are typically disk-shaped and include a hole ("bar hole") through the center of the plate that is concentric with the circumference of the plate. The hole allows the weight plate to be mounted on exercise equipment. The traditional design of Olympic weight plates includes a 2-inch center opening that exists on all weight lifting plates, regardless of their mass or weight, adapted to receive a free weight bar or a support post on a weight rack. This standard opening is beneficial for the use of free weight equipment, but may present problems for the storage of these weights.

To store the various weight plates while they are not being used, a weight rack is often used. The rack generally consists of cylindrical posts that extend from the rack either substantially parallel to the ground or with an incline to bias plates onto the post. The diameter of the posts is smaller than the diameter of the bar hole in the weight plate. To store a weight plate, the user lifts the weight plate and aligns the bar hole on the weight plate with the weight rack post, and then slides the weight plate onto the post. To facilitate this, many posts are substantially smaller (i.e. about half the diameter) than the hole so that the person does not have to perfectly align the two to get the weight on the post. The weight plates are stored by simply placing the center opening of the plate over the single support post and allowing the plate to come to rest on the support post or its connected frame. The post typically has a length that allows multiple weight plates to be stored on a single post to make efficient use of the space.

Because of the configuration of standard weight racks, weight plates of various sizes may be placed on the same post. Once a user is finished with the weight plates, he or she may not take the time to put a weight plate back on the proper bar within the rack. Thus, for example, a person may put a 5-lb weight plate back on a weight rack post and then put two 45-lb weight plates on the same post. This results in not only a disorderly-looking weight rack, but it also makes it difficult for some people to use lighter weight plates. For example, in the scenario above, a woman desiring to use the 5-lb weight plate may not have the strength to remove all of the 45-lb weight plates to get at the 5-lb weight plate. Additionally, gym staff must spend a considerable amount of time placing the weight plates back on the proper weight rack post so that the gym looks neat and orderly.

In addition, weight plates can be difficult to remove from a rack, if they are drawn from the rack at a slight angle to the bar. When the weight plate is thus tilted, one edge of the plate forming bar hole rubs against the bar, making the weight plate cling to the bar. A person must therefore wiggle the weight as they withdraw it from the rack. This is inconvenient, and makes it difficult for some people to rack or unrack heavy weight plates, especially with one hand.

Thus, there is a need for a free weight organization system that ensures proper placement of the weight plates. It may be desirable for the system to make it easy and simple for a user to place a particular free weight plate back on its proper rack post within the system, in order to reduce situations where multiple different weight plates are disposed on the same post.

SUMMARY

According to one aspect of the current disclosure, an organization system is provided for free weights where a given free weight plate may only be placed on the proper post on the weight rack. Such an organization system may include the organization system having keyed weight rack posts that are designed to mate with one or more racking recesses formed in weight plates of a specific mass or weight.

According to one configuration, a weight rack may be provided with multiple keyed rack posts, with multiple posts being keyed for receiving weight plates of different masses/weights.

According to another aspect, weight plates of varying sizes are provided, with each size of weight plates having unique racking recesses to be received by racking projections on corresponding racking posts. According to one configuration, racking recesses may vary in placement from one size weight plate to another. According to other configurations, racking recesses may vary in shape and/or size from one size weight plate to another.

According to one aspect, two or more racking recesses may be provided on each weight plate. The racking recesses may be spaced to provide balance to the weight plate.

According to another aspect, the weight plates may be provided with a racking recess which forms a loading rest recess, and the keyed rack posts may be provided with a corresponding loading rest rod. The loading rest rod may make the placement of the weight plates on the weight rack easier, by allowing the loading rest rod to carry the load of the weight plate while the user ensures that it is properly aligned. Additionally, the loading rest rod and the loading rest recess may be configured to engage one another to substantially auto-align the weight so that the user may simply slide the plate back once it is aligned.

According to another aspect, the keyed rack posts may be configured to be connected to a standard weight rack such as the type already known in the art.

According to one aspect, free weight plates and a weight rack are provided such that the weight plates cannot be placed on the weight rack incorrectly.

According to another aspect, a method is provided whereby a user may store in an organized fashion a free weight plate on the appropriate post of a weight rack.

According to another aspect of the present disclosure, existing weight plates may be cut or ground and provided with an insert which includes a bar hole with a racking recess, etc. to enable existing weights to be used in accordance with the present disclosure.

In some embodiments the insert may have a tiltable member which facilitates removal of the weight plate from the rack.

These and other aspects of the present disclosure are realized in free weight organization system shown and described in the following figures and related description.

BRIEF DESCRIPTION OF THE DRAWINGS

Various configurations of the present disclosure are shown and described in reference to the numbered drawings wherein.

Figure 1:
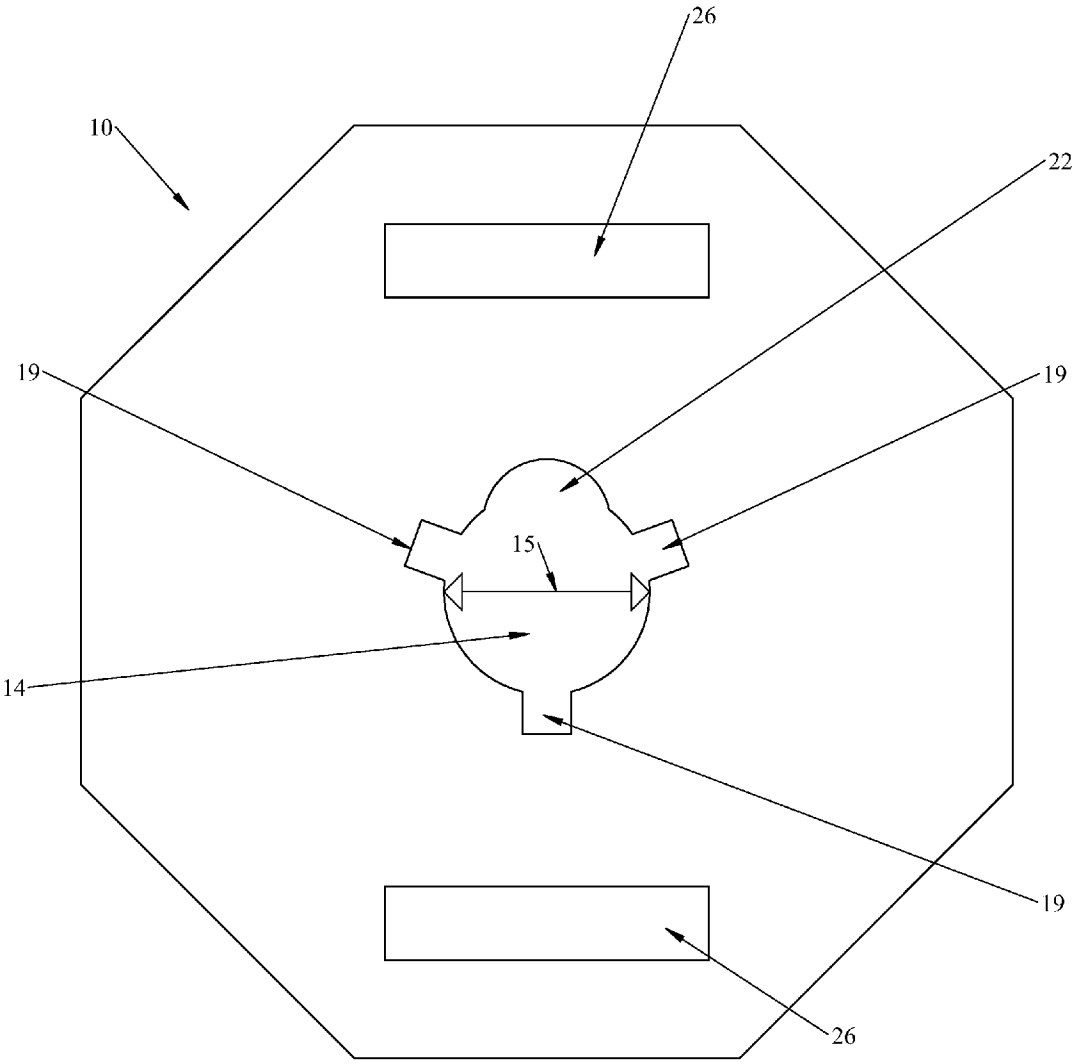
FIG. 1 illustrates a front view of an exemplary weight plate according to one configuration.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The following description includes various representative configurations and specific details in order to provide a thorough understanding of the present disclosure. The skilled artisan will understand, however, that the methods and devices described below can be practiced without employing these specific details, or that they can be used for purposes other than those described herein. Indeed, they can be modified and can be used in conjunction with products and techniques known to those of skill in the art in light of the present disclosure.

Reference in the specification to "one configuration," "one embodiment" "one aspect" or "a configuration," "an embodiment" or "an aspect" means that a particular feature, structure, or characteristic described in connection with the configuration may be included in at least one configuration and not that any particular configuration is required to have a particular feature, structure or characteristic described. The appearances of the phrase "in one configuration" or similar phrases in various places in the specification are not necessarily all referring to the same configuration, and may not necessarily limit the inclusion of a particular element of the invention to a single configuration, rather the element may be included in other or all configurations discussed herein. Thus it will be appreciated that the claims are not intended to be limited by the representative configurations shown herein. Rather, the various representative configurations are simply provided to help one of ordinary skill in the art to practice the inventive concepts claimed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

Prior to discussing particular configurations, it should be understood that the present invention is not limited to any particular structures, process steps, or materials discussed or disclosed herein, but is extended to include equivalents thereof as would be recognized by those of ordinary skill in the relevant art. More specifically, the invention is defined by the terms set forth in the claims. It should also be understood that terminology contained herein is used for the purpose of describing particular aspects of the invention only and is not intended to limit the invention to the aspects or configurations shown unless expressly indicated as such.

Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a spring" may include one or more of such springs, and reference to "the layer" may include reference to one or more of such layers.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The invention and accompanying drawings will be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Turning now to FIG. 1, there is shown one possible configuration for a free weight plate, generally indicated at 10, that may be used in a weight plate organization system. (As used herein, weight plate refers to a physical structure having mass or weight which is lifted for exercise and is not limited to a structure that is plate shaped). The weight plate 10 includes a bar hole 14 which may be defined by an inner surface of the weight plate. Bar hole means a void to receive various exercise equipment. For example, the bar hole 14 may be a generally circular void with a circumference to receive an Olympic-sized barbell. The bar hole 14 may be disposed in the center of the weight plate 10 and may be concentric with the weight plate diameter.

While the bar hole 14 may be primarily circular and may have a primary diameter 15, such as that commonly used with Olympic barbells, the bar hole 14 may also include at least one racking recess 19 which forms a channel or space extending from the main portion of the bar hole 14 defining the primary diameter. Racking recess means an indentation, slot, groove, channel, etc. on the perimeter of the bar hole 14. The racking recess 19 is configured to receive a racking projection on a keyed rack post (discussed in detail below). The racking recess 19 may be of different sizes and shapes. Moreover, a single weight plate 10 may be provided with one or more racking recesses 19, and the racking recesses 19 may be in different configurations. The size, shape, and/or placement of the racking recess 19 may vary from one size weight plate to another.

In the configuration shown in FIG. 1, the bar hole 14 includes three racking recesses 19, which are disposed approximately equal distances apart from each other along the perimeter of the bar hole 14. It may be desirable to place the one or more racking recesses 19 approximately equal distances apart to provide balance to the weight plate 10.

The bar hole 14 may also include a recess which is disposed along the top portion of the bar hole and wherein is referred to hereafter as the loading rest recess 22. Loading rest recess means an indentation, recess, groove, channel, etc. on the perimeter of the bar hole 14 which helps orient the weight plate prior to advancement along the post. The loading rest recess 22 may be of various shapes and sizes including those of the racking recesses. Depending on the structure of a post on which the weight plate is to be placed, the loading rest recess may serve as a racking recess or may simply aid in loading the weight plate on the post.

In one configuration, the loading rest recess 22 is a portion of a semi-circle with a smaller circumference or radius of curvature than the bar hole 14 and is disposed at the top center of the bar hole 14. The loading rest recess 22 may be shaped to mate with the loading rest rod of the weight rack, as described below. The weight plate 10 may also include one or more handles 26 to assist in the handling, lifting, placement, etc. of the weight plate 10.

One concern with prior attempts to require a user to place a weight plate on a given post system is that the user must not only lift the weight plate onto the rack, he or she must rotate the weight plate into a given position before it will advance. The loading rest recess, in contrast, allows a user to simply mount the weight plate 10 on a post (see FIG. 3) with the post carrying the weight of the weight plate. The plate then need only be rotated until the loading rest recess comes into alignment with a particular portion of the post. At that point the weight plate is in alignment and can be pushed back along the post.

Figure 2:
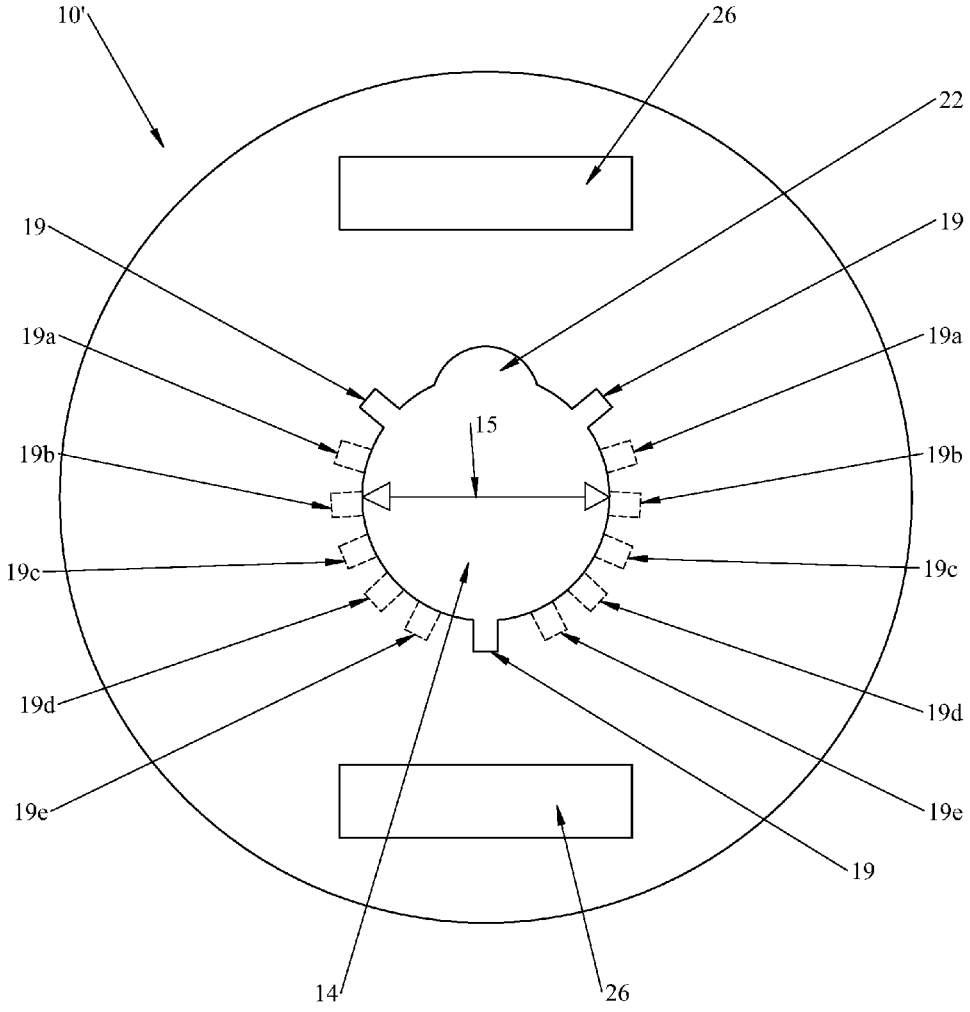
FIG. 2 illustrates a front view of an exemplary weight plate according to another configuration.

FIG. 2 shows another possible configuration of a weight plate 10' to be used in a weight plate organization system. The weight plate 10' may have a generally round shape, compared to the octagonal shape of the weight plate 10 in FIG. 1. The weight plate 10' may be of the same weight as the weight plate 10 shown in FIG. 1, and may thus have a similar placement of the racking recesses 19 compared to the weight plate 10 shown in FIG. 1. The dashed lines in FIG. 2 indicate possible placements of racking recesses 19*a*-19*e* to be used for weight plates of different weights. By way of example, racking recesses 19 may be used for a 45-pound weight plate, racking recesses 19*a* may be used for a 35-pound weight plate, racking recesses 19*b* may be used for a 25-pound weight plate, racking recesses 19*c* may be used for a 10-pound weight plate, racking recesses 19*d* may be used for a 5-pound weight plate, and racking recesses 19*e* may be used for a 2.5-pound weight plate.

According to one configuration, the racking recesses may be placed such that they provide balance to the weight plate 10', for example, they may be equal distances apart from the center of the weight plate 10'. In FIG. 2, racking recesses 19*a*, which may be used for a 35-pound weight, are formed or placed equal distances apart from the center of the weight plate 10'. This may be desirable to provide a more equal weight distribution for the weight plate 10'. Similarly, racking recesses 19*b-e* may also be formed or placed equal distances apart from the center of the weight plate 10'.

The weight plate 10' may also include a loading rest recess 22, disposed at the top center of the bar hole 14. While the loading rest recess 22 is shown as being circular in shape, it could be configured to have various other shapes as well, such as triangular, rectangular, etc., and could be configured to be various sizes. The weight plate 10' may also be provided with handles 26 to assist in the handling, placement, and storage of the weight plate 10'.

Although the racking recesses shown in FIGS. 1 and 2 are generally rectangular, the racking recesses could be of other sizes, shapes, and configurations. For example, the racking recesses may be semi-circles or generally triangular. The free weight plates of different weights may have the size, shape, and/or placement of the racking recess(es) vary from one size weight plate to another. As shown in FIG. 2, the racking recesses vary in placement from one size weight plate to another.

Figure 3:
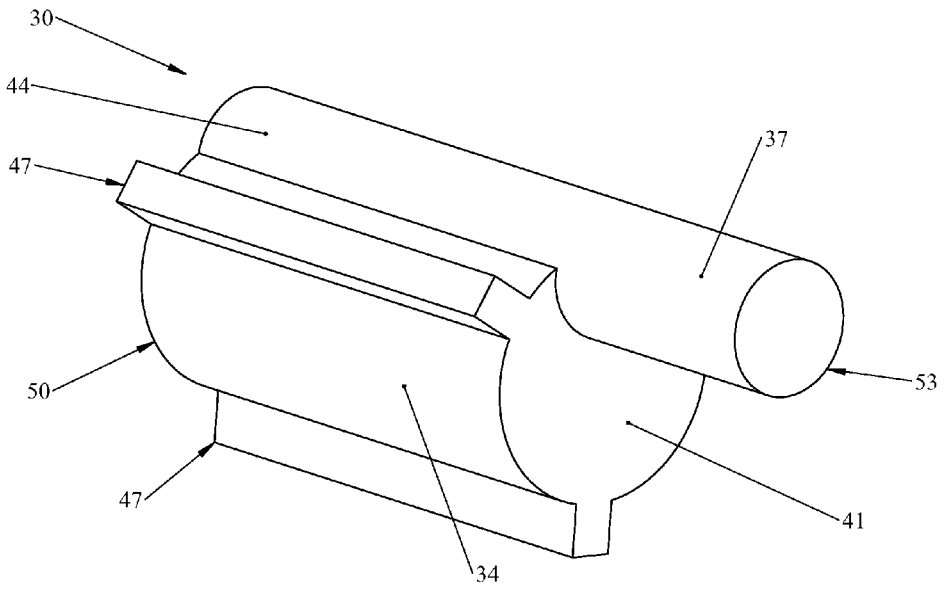
FIG. 3 shows a perspective view from the proximal end of an exemplary keyed weight rack post.

Turning now to FIG. 3, there is shown a perspective view of one possible configuration of a keyed rack post, generally indicated at 30. The keyed rack post 30 has a distal end 50, for connection to a weight rack, and a proximal end 53. This keyed rack post 30 is usually disposed horizontally or with an incline with the proximal end (i.e. end adjacent a user) being disposed higher than the distal end.

The keyed rack post 30 is comprised of a base portion 34, and may also include a loading rest rod 37. The loading rest rod 37 may be of a smaller diameter or other cross-sectional area than the base portion 34 and extends outwardly from the base portion. The smaller diameter/cross-sectional area makes it easier for a user to mount the weight plate 10 on the loading rest rod which will then support the weight of the weight plate while the user aligns the weight plate and slides it back onto the base portion. Moreover, the loading rest rod 37 may be configured to engage the loading rest recess 22 of the weight plate 10 to substantially auto-align the weight plate for advancement onto the base portion 34. If the user places the weight plate 10 on the loading rest rod 37 with the loading rest recess 22 at the top, the weight plate will be substantially aligned for advancement. If the weight plate 10 is not in such orientation, the user need only rotate the weight plate until the loading rest recess 22 aligns with the loading rest rod 37 and then advance the weight plate. This is much easier than many configurations of the prior art.

The base portion 34 may include a lower central portion 41. In one configuration, the lower central portion 41 may have a circumference that is shaped to receive a standard, Olympic-sized weight plate. The length of the base portion 34 may vary depending on the needs. For example, in commercial gym settings, the length of the base portion 34 may be such that it can hold several weight plates. In home settings, the length may be shorter.

The base portion 34 also may include at least one racking projection 47. In the configuration shown in FIG. 3, there are 3 racking projections 47. Racking projection(s) 47 may be sized to be received in one or more racking recesses 19 of a weight plate 10. The base portion 34 may have the racking projections vary in size, shape, and/or placement such that each keyed rack post 30 may only accept one size of free weight plate 10. In this manner, it may not be possible for the incorrect weight plate to be placed and advanced on the wrong keyed rack post, because the keyed rack post would not accept the weight plate. In other words, weight plates of different masses/weights would have to be placed on different keyed rack posts.

In one configuration, the base portion 34 may also include an upper portion 44. The upper portion 44 may also have a circumference, and the circumference may be smaller than the circumference of the lower central portion 41, and may be shaped to receive the loading rest recess 22 of a weight plate (such as weight plate 10 of FIG. 1 or weight plate 10' of FIG. 2). The upper portion 41 may also be configured to be other various sizes and shapes.

The keyed rack post 30 may also include a loading rest rod 37. The loading rest rod 37 may be, in one configuration, a circular rod that extends horizontally from the base portion 34, and has a circumference to receive a loading rest recess 22 of a weight plate 10. For example, this circumference may be slightly smaller than the circumference of the bar hole 14. The loading rest rod 37 may have any length desired, and in one configuration has a length about the width of an Olympic weight plate, such that a single weight plate can be placed on the loading rest rod 37 at a time. One having skill in the art appreciates that the loading rest rod 37 may also be of other various sizes, lengths, and shapes.

The loading rest rod 37 may serve to assist in the ease and correct placement of a weight plate 10 on the keyed rack post 30. For example, when a person is done with a particular free weight plate 10, s/he may place the weight plate 10 on the loading rest rod 37 such that the loading recess 22 engages the loading rest rod 37. The loading rest rod 37 engagement with the loading recess 22 of a weight plate 10 of the appropriate weight will also ensure that the racking recesses 19 are in a position to be engaged by the racking projections 47 once the user slides the weight plate 10 towards the center of the weight rack. This may simplify the use of the free weight management system, and save the user from having to rotate the weight plate 10 until the racking recesses 19 line up perfectly with the racking projections 47. Placement of the loading recess 22 of the appropriate weight plate on the appropriate loading rest rod 37 ensures proper positioning of the racking recesses 19 with the racking projections 47 without any further adjustment by the user. If the weight plate is placed on the loading rest rod and the loading rest rod is not aligned with the loading recess, the plate must merely be rotated until the two align. This is usually much easier than attempting to align small holes, etc. as have been attempted in the prior art.

Figure 4:
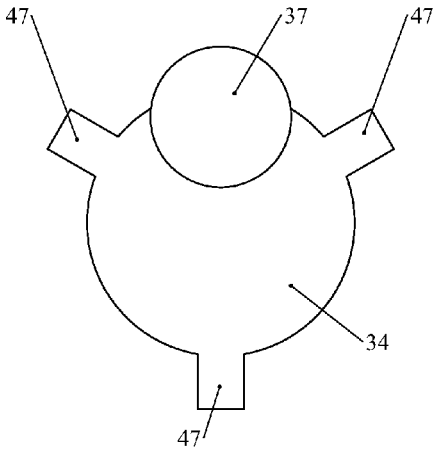
FIG. 4 shows a front end view from the proximal end of the weight rack post of FIG. 3.

FIG. 4 shows a front view from the proximal end 53 of the keyed rack post 30 of FIG. 3. The base portion 34 can be seen, as well as the loading rest rod 37, and racking projections 47. The placement, size, and shape of the racking projections 47 may vary according to the mass/weight of weight plate 10 that the keyed rack post 30 is configured to store, and may correspond to the placement, size, and shape of the racking recesses 19 of the corresponding weight plates 10. Moreover, the number of recesses may vary as well. For example, a plate of one mass/weight may only have two recesses and a plate of another mass/weight may have three. Thus, the post 30 is not required to have three projections 47 as shown in FIG. 4.

Figure 5:
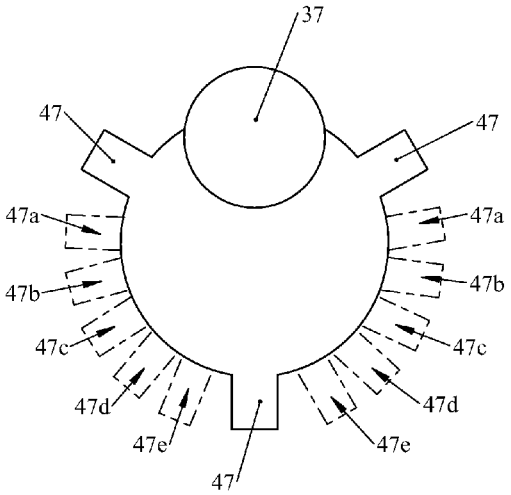
FIG. 5 shows the weight rack post of FIG. 4 with other exemplary configurations for racking projections shown in dashed lines.

FIG. 5 shows in dashed lines exemplary possible placements for racking projections 47*a-e*. These exemplary possible placements for racking projections 47*a-e* correspond to the exemplary possible placements for racking recesses 19*a*-19*e* of FIG. 2. One of skill in the art will appreciate that numerous other sizes, shapes, and placements for racking recesses may be used. According to some configurations, a single racking recess may be provided. According to other configurations, two or more racking recesses may be provided.

Figure 6A:
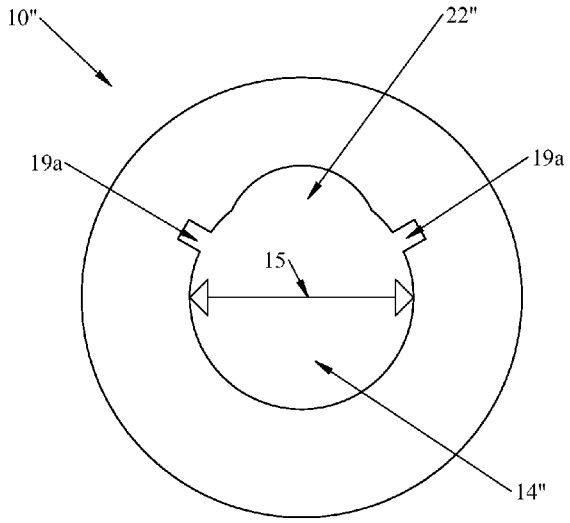
FIG. 6A shows a front view of another exemplary weight plate.
Figure 6B:
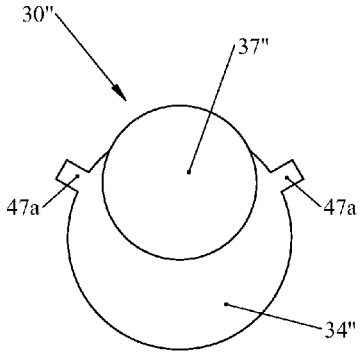
FIG. 6B shows a front view of an exemplary keyed weight rack post for receiving the weight plate of FIG. 6A.

Turning now to FIGS. 6A and 6B, there are shown front views of one exemplary configuration of a weight plate 10" and its corresponding keyed rack post 30", respectively. In FIG. 6A, weight plate 10" includes a bar hole 14", a loading rest recess 22", and racking recesses 19*a*. This configuration of racking recesses may be used, for example, with a weight of 35 pounds. In FIG. 6B, the keyed rack post 30" includes a base portion 34", a loading rest rod 37", and racking projections 47*a*. The loading rest rod 37" of FIG. 6B is shaped to receive the loading rest recess 22" of FIG. 6A. Once the loading rest recess 22" of the weight plate 10" is placed on the loading rest rod 37" of the keyed rack post 30", the weight plate 10" will be in position to be pushed farther onto the keyed rack post 30", and the racking recesses 19*a* will be lined up with the racking projections 47*a* without any further need for the user to adjust or turn the weight plate 10".

Figure 7A:
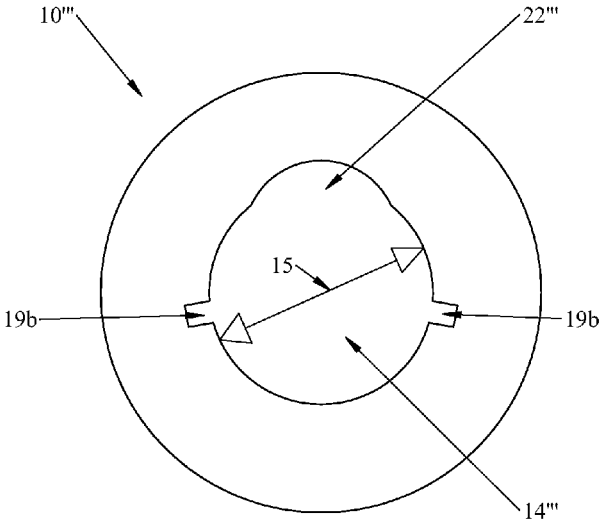
FIG. 7A shows a front view of another exemplary weight plate.
Figure 7B:
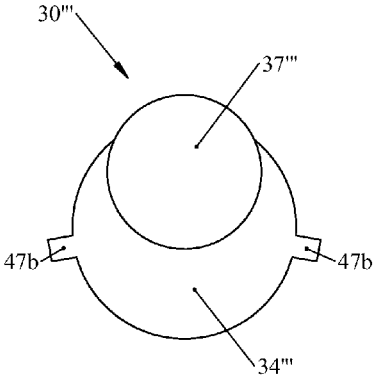
FIG. 7B shows a front view of an exemplary keyed weight rack post for receiving the weight plate of FIG. 7A.

Similarly, FIGS. 7A and 7B show front views of another exemplary configuration of a weight plate 10''' and its corresponding keyed rack post 30''', respectively. This weight plate 10''' may correspond to a weight plate having a weight of 25 pounds, for example. The racking recesses 19*b* are sized to engage the racking projections 47*b*. Once the loading rest recess 22''' of the weight plate 10''' is placed on the loading rest rod 37''' of the keyed rack post 30''', the weight plate 10''' will be in position to be pushed farther onto the keyed rack post 30''', and the racking recesses 19*b* will be lined up with the racking projections 47*b* without any further need for the user to adjust or turn the weight plate 10'''.

Figure 8:
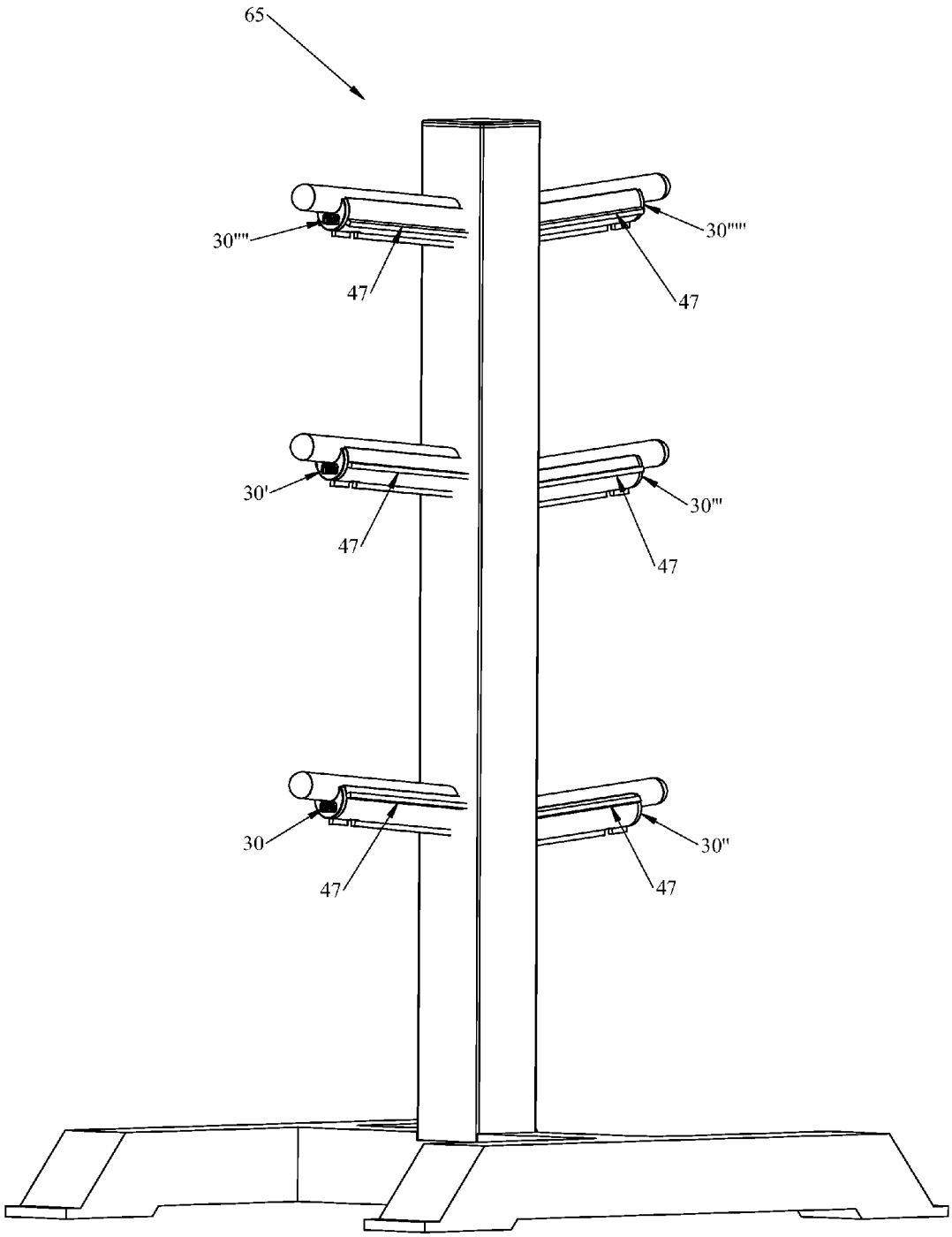
FIG. 8 shows a perspective view of weight rack according to one configuration.

In one configuration, a weight rack may be provided that includes at least one racking post integral to the weight rack. Any configuration of weight rack may be used. For example, a weight rack tree, such as the weight rack tree 65 shown in FIG. 8, may be provided with a plurality of keyed rack posts 30, 30', 30", 30''', etc. Each keyed rack post may have a different size, shape, or placement of racking projections corresponding to the mass/weight of the weight plate to be stored on the particular keyed rack post 30.

Figure 9:
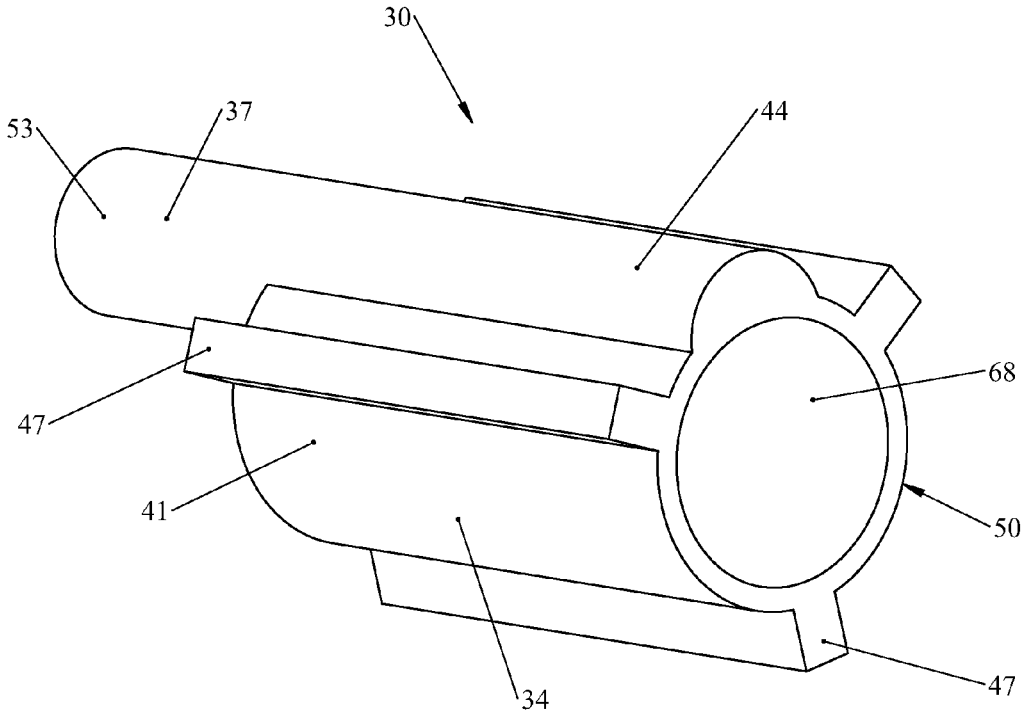
FIG. 9 shows a perspective view from the distal end of the keyed weight rack post of FIG. 3.

In another configuration, keyed rack posts 30 may be provided that can be fitted to a standard weight rack. FIG. 9 shows a perspective view from the distal end 50 of a keyed rack post 30. The distal end may be configured for connection to a post of a conventional weight rack. By way of example, the distal end 50 may be provided with a void 68. A standard post from a weight rack may be inserted into void 68 to connect the keyed rack post 30 to a standard weight rack. This configuration may allow a user (such as a commercial gym) that already owns a weight rack to retrofit the weight rack into the type that can be used to organize weight plates and prevent misplacement of weight plates.

Figure 10A:
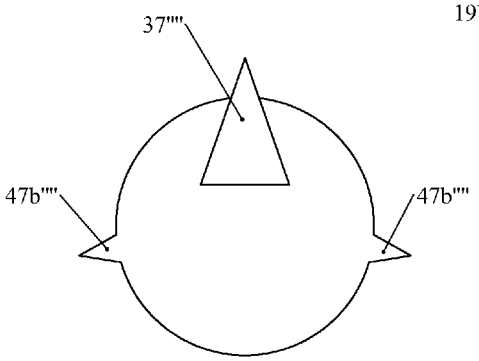
FIGS. 10A and 10B shows an end view an alternate keyed post and front view of a keyed weight plate, respectively.
Figure 10B:
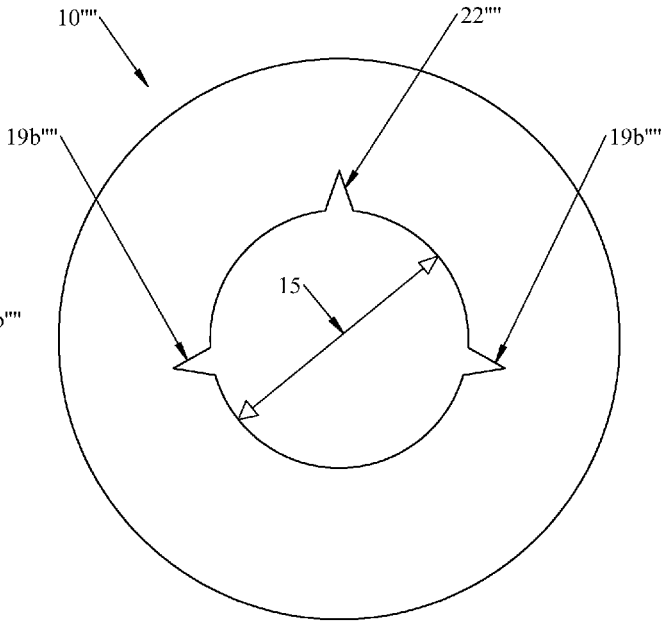

Turning now to FIGS. 10A and 10B, there is shown an alternate configuration. The elements are generally the same and are therefore numbered accordingly to FIGS. 7A and 7B with four primes. The principle difference is the recesses 47*b*'''' and the loading rest recess are generally triangular. It will be appreciated that other shapes may also be used.

Figure 11A:
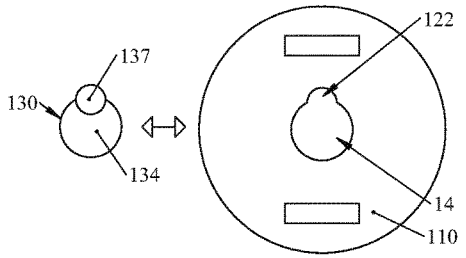
FIGS. 11A through 11E show end views of an alternate configuration of weight plates and rack posts in which the loading rest recess and rest rod are selected from a variety of shapes which is correlated to nest with a portion of the post of the weight rack so that each sized weight plate may only be securely mounted on a single post.

FIGS. 11A through 11E show end views of an alternate configuration of the posts 130 and weights 110. In FIG. 11A, post 130 is comprised of a base portion 134, and may also include a loading rest rod 137 which typically has a smaller cross-section than the base portion. The weight 110 includes a bar hole 114 having a given cross-sectional area or primary diameter, and a load rest recess 122 which allows the weight plate to be disposed and centered on the loading rest rod 137 of the post 130.

Figure 11B:
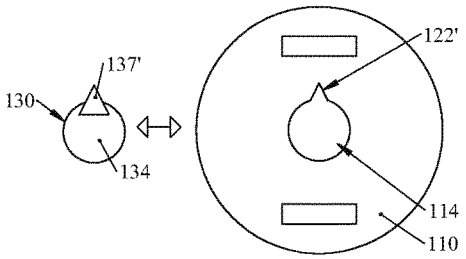

In FIG. 11A, the base portion 134 is generally smooth and the load rest rod 137 is generally circular. The bar hole 114 includes a rounded rest recess 122. In FIG. 11B, however, the load rest rod 137' is generally triangular, as is the rest recess 122' so as to receive and center the weight plate thereon. The remaining portions are generally the same as the bar hole 114 and the rack port 130 and base portion 134 and are thus numbered accordingly.

Figure 11C:
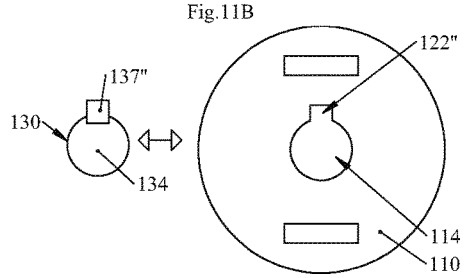
Figure 11D:
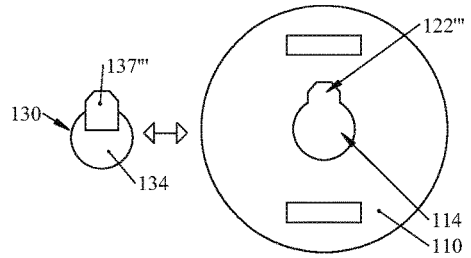
Figure 11E:
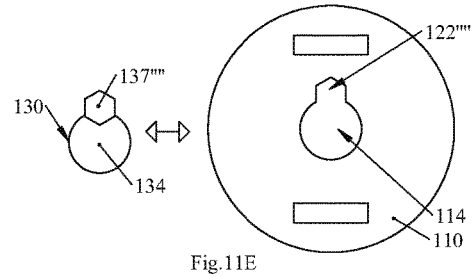

FIG. 11C has a load rest rod 137" which is generally square. The rest recess 122" is likewise squared to receive the load rest rod 137". FIG. 11D shows a load rest rod 137''' which is polygonal. The rest recess 122''' is shaped in a complementary manner. FIG. 11E shows a rack post 130 with a hexagonal load rest rod 137'''', and the bar hole 114 in the weight plate 110 has a complementary rest recess 122''''.

When used together the posts 130 and the weigh plates 110 of FIGS. 11A-11E allow five different weight plates to be used, with none of the weight plates fitting on the port designed for a weight plate of a different mass/weight. Additionally, the single load rest recess 122-122''''is easy to visually align with the load rest rod 137-137'''' and quickly centers the weight plate, thereby making it easy to place on the proper rack without undue adjustment.

Figure 12A:
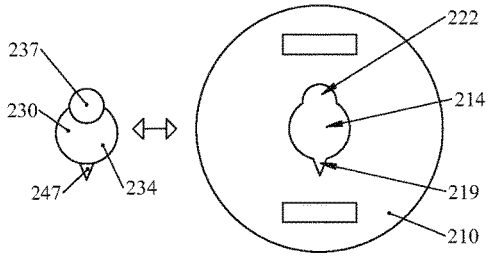
FIGS. 12A through 12E show end views of an alternate configuration of weight plates and rack posts in which each weight plate has a loading rest recess and a shaped racking recess to control which weight plate can be placed on a given rack post.
Figure 12B:
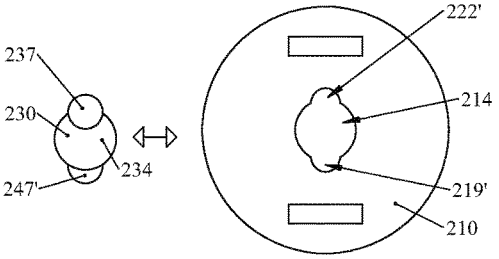
Figure 12C:
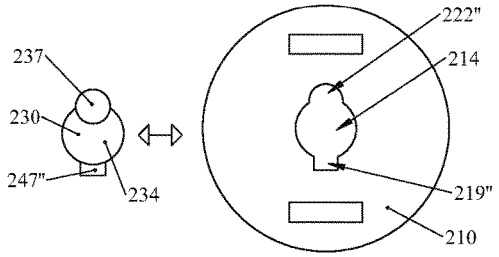
Figure 12D:
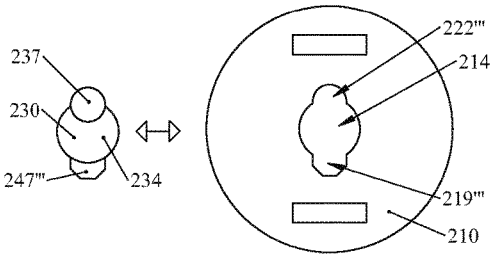
Figure 12E:
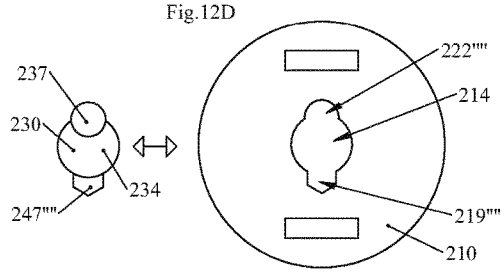

Turning now to FIGS. 12A-12E, there is shown another series of posts 230 and weight plates 210 which can be used together to limit the weight plate to a given rack post while remaining easy to use. In each of FIGS. 12A-12E, the load rest rod 237 is generally cylindrical and is received in a rounded load rest recess 222 at the top of the bar hole 214. Each of the posts 230 is keyed—i.e. has a projection 247 which is received in a racking recess 219 on the weight plate 210. In FIG. 12A, the racking projection 247 is generally triangular as is the racking recess 219. In FIG. 12B, the racking projection 247' is rounded, as is the racking recess 219'. In FIG. 12C, the racking projection 247" is squared, as is the racking recess 219". In FIG. 12D, the racking projection 247''' is champhered or polygonal, as is the racking recess 219'''. In FIG. 12E, the projection forms 4/6ths of a hexagon, as does the racking recess 219''''. The different shapes makes it easy to recognize the proper post and the load rest recess 222 and load rest rod 237 of each combination easily centers the weight plates for advancement.

Figure 13A:
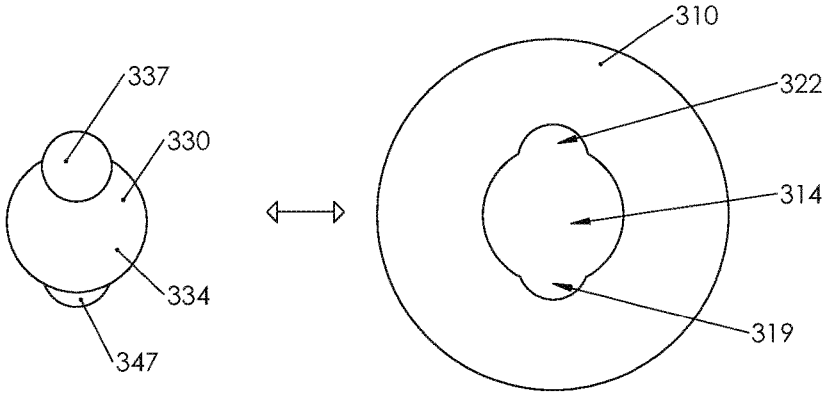
FIGS. 13A through 13C show alternate configurations of weight plates with different combinations of load rest recesses and racking recesses.
Figure 13B:
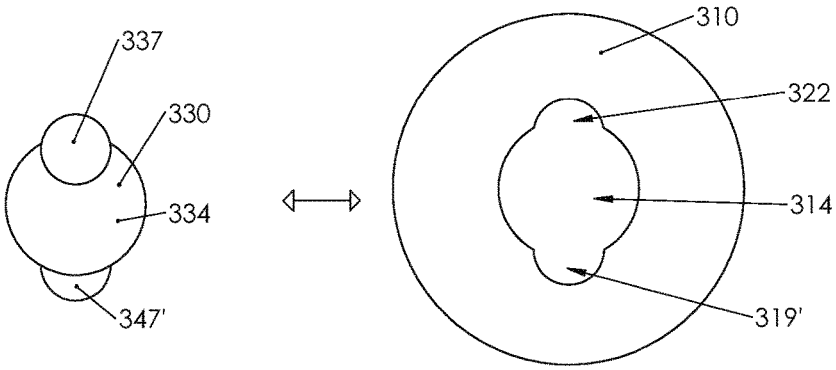
Figure 13C:
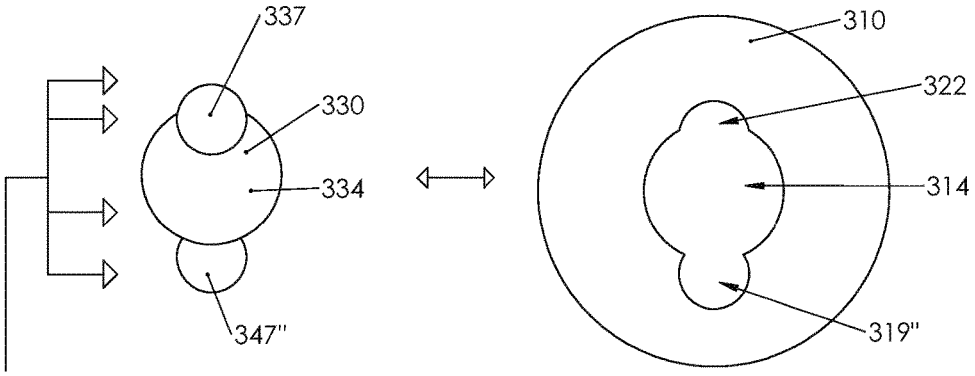

While different shapes can be used to control mounting of the weight plates, the same general shape in different locations can also be used. FIGS. 13A through 13C show alternate configurations of weight plates 310 with a common load weight recess 322. The racking recesses 319-319" are all generally rounded, but may extend different distances to thereby allow each weight plate to fit on a given rack post 330. Alternately or in addition, projections 347 of different lengths can be used to limit which plate can be mounted on a given post. While the load rest rods 337 of each post is shown as being the same, it will be appreciated that the distance that the load rest rod extends upwardly from the base portion 334 could also be adjusted so each weight plate will fit on one particular post.

Figure 14A:
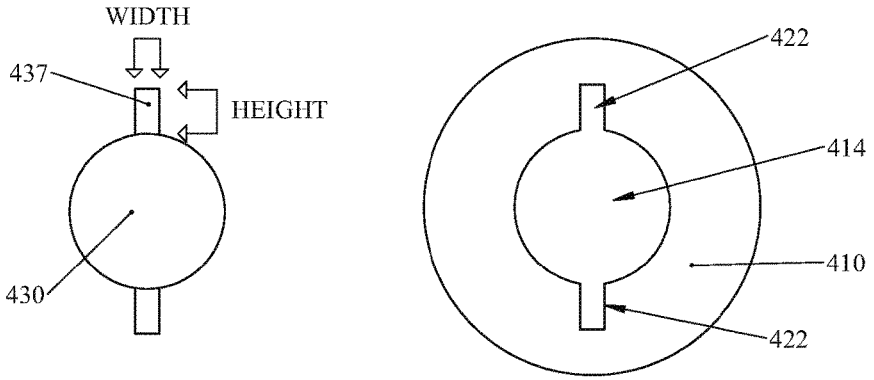
FIGS. 14A through 14C show end views of an alternate configuration of weight plates and rack posts in which the rack posts use a plurality of rectangular shapes to limit the placement of weight plates on the posts.
Figure 14B:
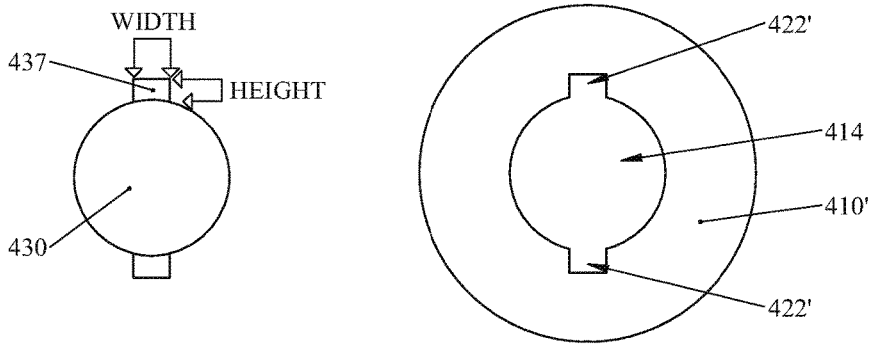
Figure 14C:
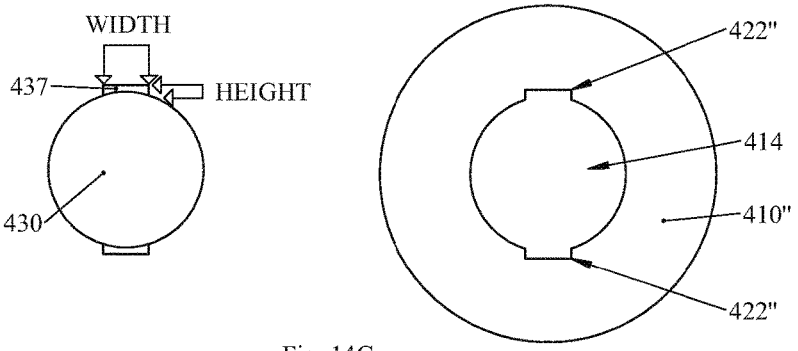
Figure 14D:
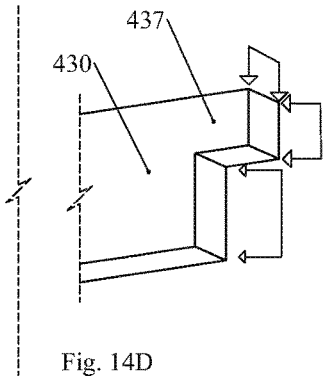
FIGS. 14D and 14E show alternate post configurations which may be used with the weight plates of FIGS. 14A through 14C.

FIGS. 14A through 14C show end views of an alternate configuration of weight plates 410-410". The bar holes 414 each have a pair of recesses 422, 422' and 422" respectively extending therefrom. The recesses are generally opposite one another so that either can serve as the load rest recess and receive a load rest rod 437 as shown on post in the adjacent post, or as shown at 430 in FIG. 14D. In FIG. 14A the recesses 422 are very thin and tall. In FIG. 14B they are shorter and wider, and in FIG. 14C they are still shorter and broader. Thus, a rack post desired to receive one weight plate will not receive one of another weight plate of a different configuration.

Figure 14E:
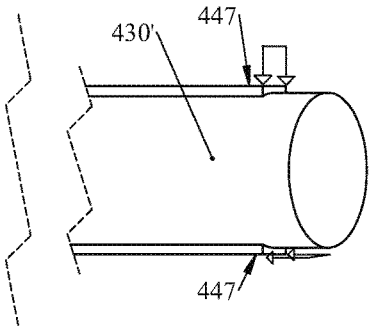

In the alternative, the recesses 422-422" can be used more like racking recesses and engage projections 447 on a post 430' as shown in FIG. 14E in which the rack posts use a plurality of rectangular shapes to limit the placement of weight plates on the posts. Either way, a given post will generally only receive a weight plate of a given mass or weight.

Figure 15:
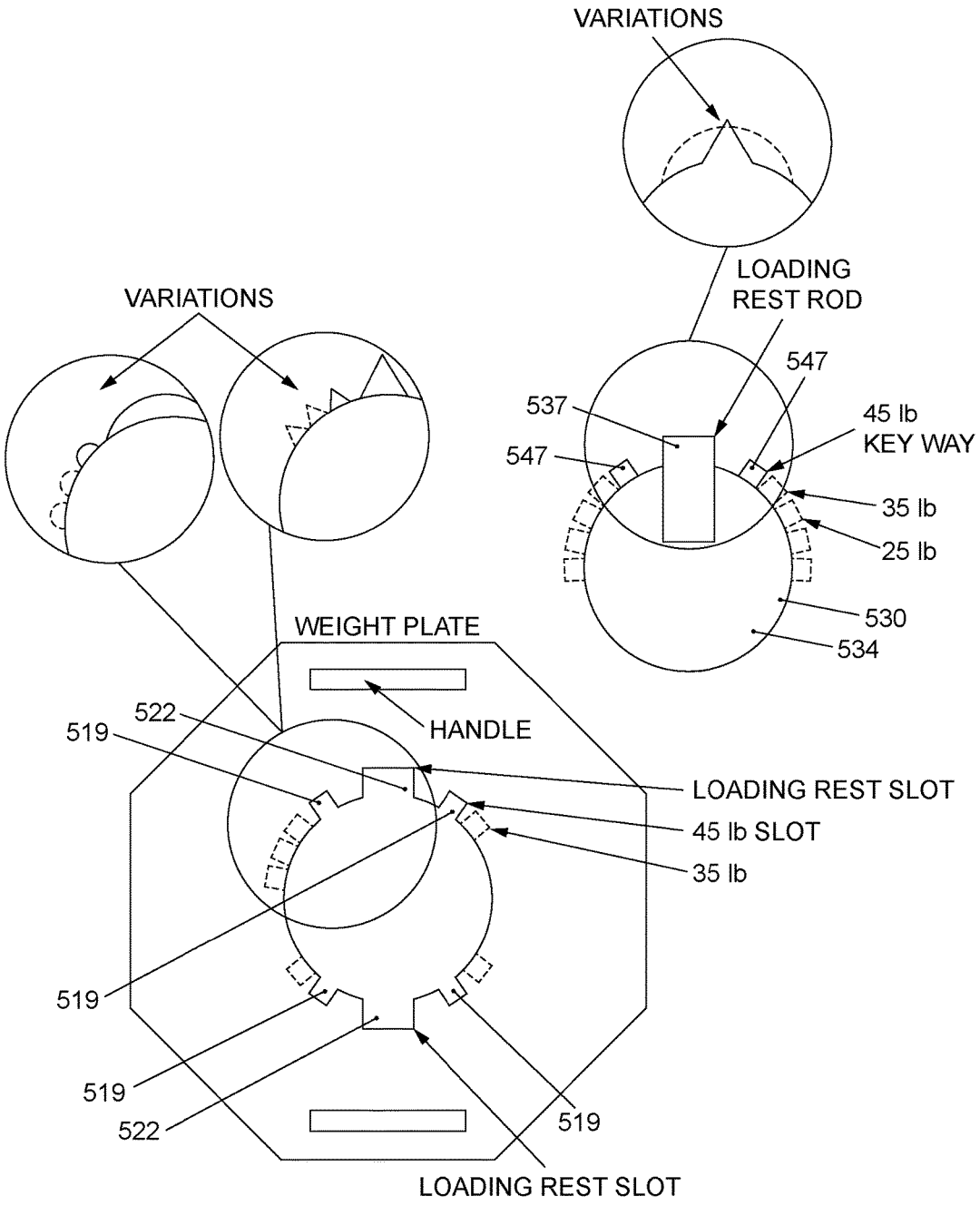
FIG. 15 shows an end view of a weight plate and a pack post wherein the load rest recess and the other racking recesses are provided in mirror image to facilitate placement on a rack post.

FIG. 15 shows an end view of a weight plate 510 and a rack post 530 wherein the load rest recess 522 and the other racking recesses 519 are provided in mirror image to facilitate placement on a rack post. The weight 510 can be placed on the load rest rod 537 and advanced regardless if it is turned around or rotated 180 degrees. The recesses shown in dashed lines represent racking recesses for weight plates of different masses/weights. Also shown in FIG. 15 are a variety of variations in the rest recess, the racking recesses and the loading rest rod 537. While the weight plates shown herein 10, 110, 210, 310, 410, 510 have been shown in groups which are generally consistent in diameter, it will be appreciated that the each of the weight plates will typically have a diameter correlated with its mass/weight. Thus, for example, a 45 lb. (or 20 Kg.) weight plate will be much larger than a 10 lb. (or 5 Kg.) weight plate and so forth. Thus, the bar hole 14, 114, 214, 314, 414, 514 will be larger as a proportion of the overall size on the smaller weight plates and make up a small proportion on the heavier weight plates.

Figure 16:
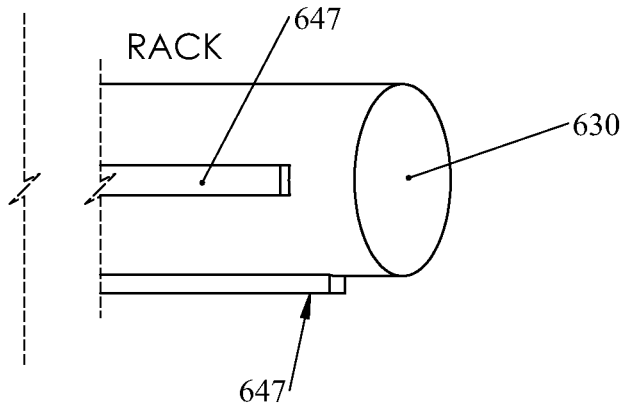
FIG. 16 shows an end view of a weight plate and a perspective view of a post as used in an alternate configuration of the invention.
Figure 16:
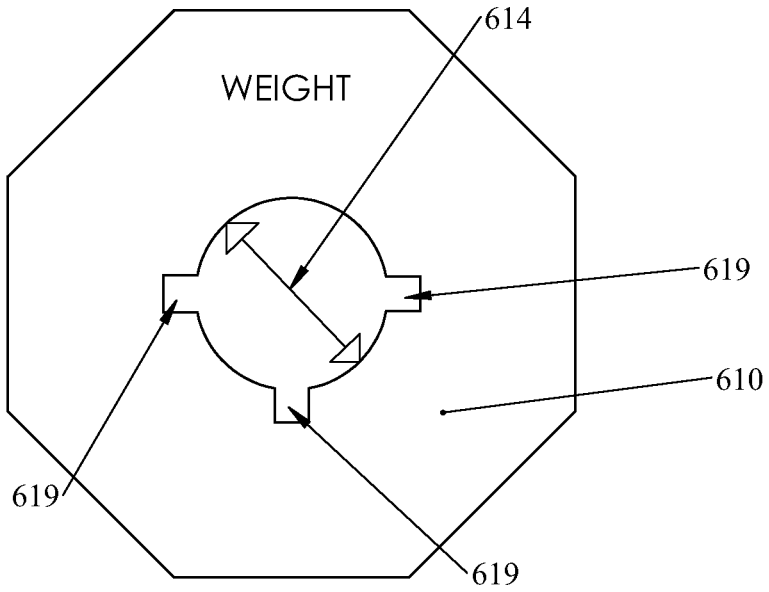

FIG. 16 shows an end view of a weight plate 610 and a perspective view of a post 630 as used in an alternate configuration. The weight plate 610 does not include a load rest recess. Rather, it includes 3 racking recesses 619 which are designed to receive three complementary projections 647 (only two of which can be seen in FIG. 16). The post 630 lacks a smaller diameter (or cross-section) load rest rod. Instead, the base portion is substantially the same diameter and extends beyond the projections 647 to provide a holding portion. In such a configuration, a user must center the weight plate and advance it along the post 630. It will be appreciated that the base portion could be reduced in diameter so that the end lacking the projections could act as a loading rest rod.

While the invention described above is a desirable method of forming weights to encourage proper replacement on the rack, it will be appreciated that many gyms already have a substantial amount of money invested in weights. Additionally, because the weights are generally made of steel, they do not need to be replaced often. In accordance with one aspect of the invention, it has been found that a conventional weight plate can be modified in accordance with the teachings of the present disclosure to provide the benefits discussed above.

Figure 17A:
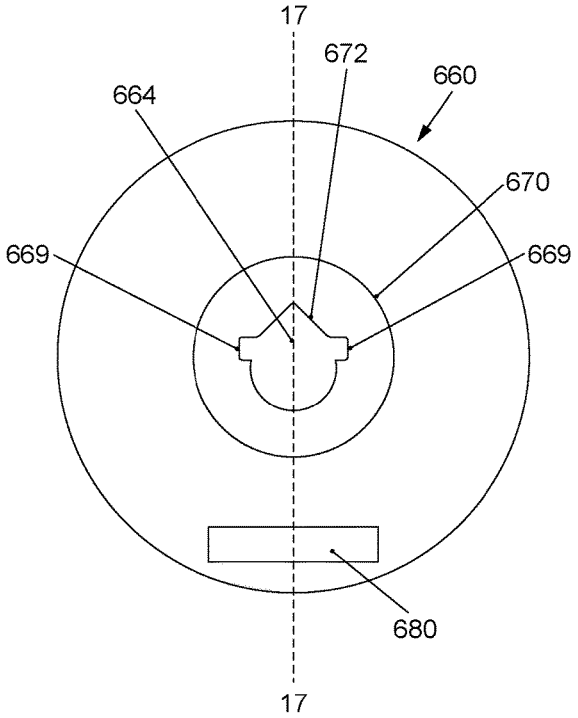
FIG. 17A shows plan view of an alternate embodiment of a weight plate with an insert as may be used to modify a conventional weight plate for use with the present invention.

Turning now to FIG. 17A, there is shown a free weight plate, generally indicated at 660, that may be used in a weight plate organization system. (As used herein, weight plate refers to a physical structure having mass or weight which is lifted for exercise and is not limited to a structure that is plate shaped). The weight plate 660 includes a bar hole 664 which may be defined by an inner surface of the weight plate—or, as shown in FIG. 17, as the inner surface of an insert 670. Because a conventional plate would not have a racking recess 669, the racking recess may be cut into the weight plate 650. In the alternative the area around the conventional bar hole of a weight plate may be cut or ground out to make room for an insert 670 which would have the racking recess 669 formed therein. As noted above, a racking recess means an indentation, slot, groove, channel, etc. on the perimeter of the bar hole 664. The racking recess 669 is configured to receive a racking projection on a keyed rack post as discussed in detail above. The racking recess 669 may be of different sizes and shapes. Moreover, a single weight plate 660 may be provided with one or more racking recesses 669, and the racking recesses may be in different configurations. The size, shape, and/or placement of the racking recess 669 may vary from one size weight plate to another.

Figure 17B:
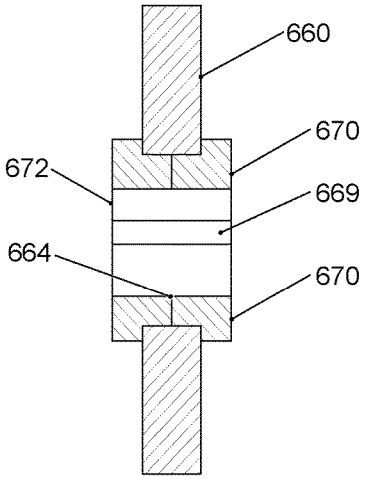
FIG. 17B shows a cross-sectional view taken along line 17-17 to show the insert and weight plate.

The insert 670 may be a single piece which is inserted into a ground or cut out area around the original bar hole of the plate and welded, bonded or otherwise attached to the plate. In the alternative, as shown in FIG. 17B, the insert 670 may be two or more pieces which are inserted into the ground or cut out area and then attached to one another by welding, bonding, or by fasteners, etc.

In the configuration shown in FIG. 17*a*, the bar hole 664 formed in the insert 670 includes two racking recesses 669 and a loading rest recess 672. Loading rest recess means an indentation, recess, groove, channel, etc. on the perimeter of the bar hole 14 which helps orient the weight plate prior to advancement along the post. The loading rest recess 672 may be of various shapes and sizes including those of the racking recesses. Depending on the structure of a post on which the weight plate is to be placed, the loading rest recess may also serve as a racking recess or may simply aid in loading the weight plate on the post.

Also shown in FIG. 17A is a centering weight 680 which may be attached to the plate. The centering weight 680 is configured to bias the weight plate 660 so that the centering weight is at the bottom. Thus, when a user places the weight plate 660 on a rack post, the centering weight 680 urges the weight to rotate so that the loading recess 672 (if present) is disposed at the top so that the weight plate may be advanced on the rack post. The centering weight can also be used for branding the retrofitted plates.

Those skilled in the art will appreciate that it is desirable to keep the weight plate 660 at substantially the same weight after the retrofitting process. Thus, the insert 670 and any centering weight 680 should preferably weigh about the same amount as the material cut or ground from the weight plate 660. However, it will be appreciated that the insert could also be used to modify the weight of a plate, such as, for example, to convert a weight plate from pounds to the closest associated standard kilogram weight.

Figure 18B:
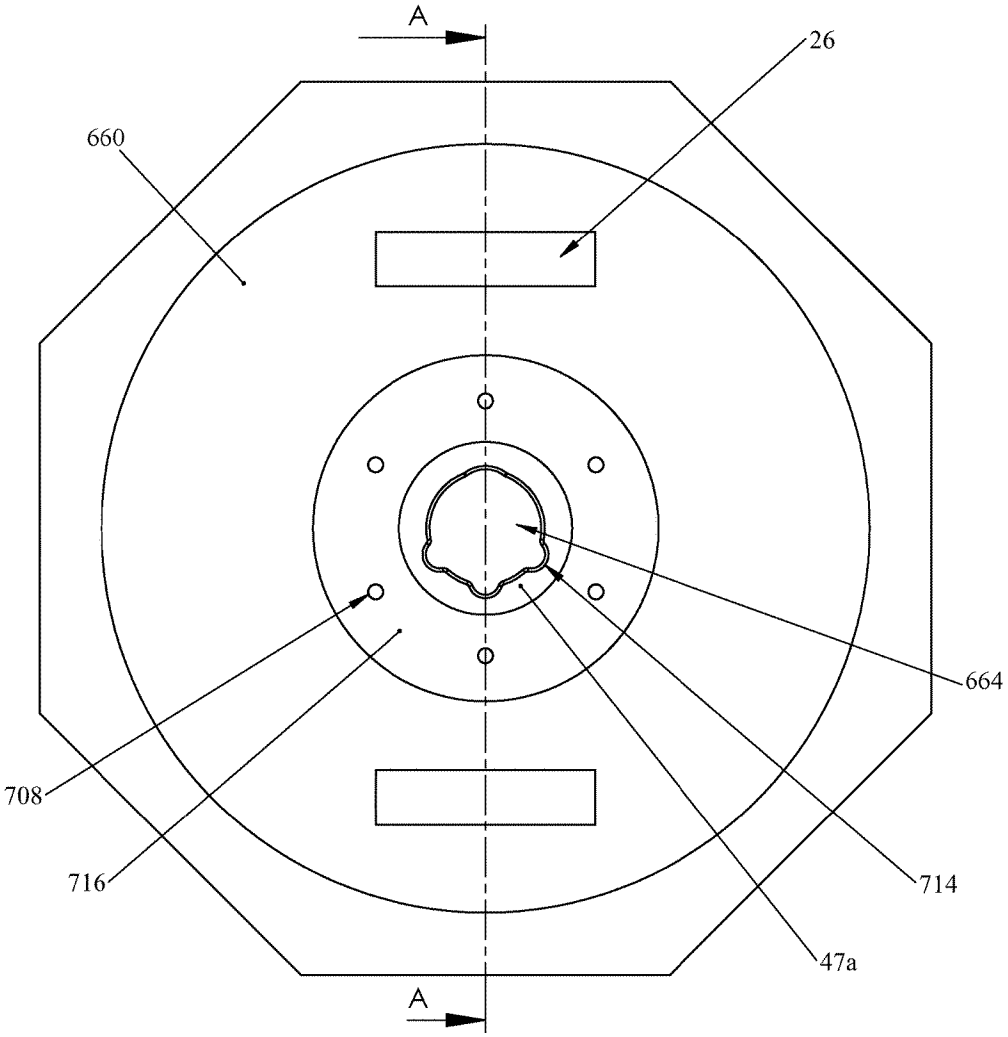
FIG. 18B shows a frontal view of the insert and weight plate of FIG. 18A.
Figure 18A:
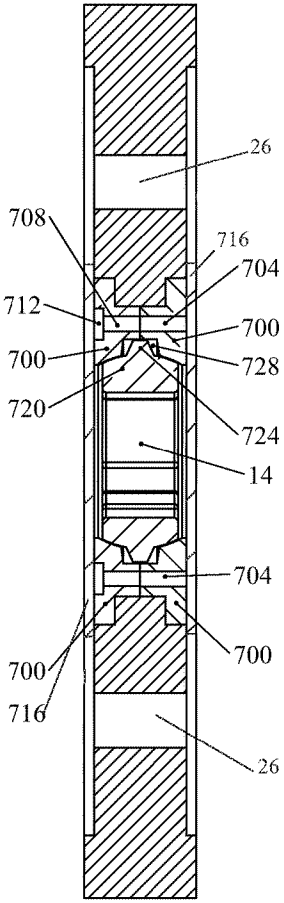
FIG. 18A shows a cut-away side view of a weight plate with an insert and a tiltable member.

FIG. 18A shows a cross-sectional, side view of a weight plate 660 in which the original bar hole has been drilled out similar to FIGS. 16A and 16B. The weight plate 660 further comprises one or more inserts 700. These inserts may be applied in a single section, in two sections or in multiple sections. The inserts 700 may be set flush with the edge of the weight plate 10 or may be recessed. The inserts 700 may include, for example, threaded channels 704 for receiving fasteners 708 such as bolts, screws, or rivets, or other types of securing means. The end of the fasteners may fit into a recess 712 so as not to catch on surfaces such as clothing or carpet.

The inserts 700 may be integral with, or separate from collars 716 which may engage the faces of the plates. It is advantageous if the collars 716 fit closely against the inserts 700 and the weight plate 10, to prevent fingers, hair, or clothing from being pinched.

The collars 716 and inserts 700 may contain a tiltable member or bearing 720 which is placed within the void at the center of the plate. The bearing 720 may define the bar hole 664.

The bearing 720 may be configured to provide a limited range of tilting motion permitted by a guide member 724 which is slidable in either direction in a pocket 728. The guide member 724 may be, for example, a ridge or a wheeled ledge, or any other means of keeping the tiltable member 720 steady. It will be appreciated that, although the present embodiment shows the pocket 728 as a depression in the insert 700, and the guide member 724 as a ridge along the bearing 720, these features may be reversed, so that the bearing has the pocket 728. The pocket 728 or the guide member 724 may be coated with a friction-reducing film (not shown) which can smooth the action of the bearing 720. This enables the bearing 720 with a tilting range of motion of 20-30 degrees.

When most weight plates are removed from a weight rack, the user must either take care to precisely angle the weight plate to match the angle of the weight rack post, or must shimmy and twist the weight plate in order to remove it due to the slight upward angle of the post. This is because the edges of a conventional bar hole catch against the rack bar (i.e. the upper edge of one side and the lower edge of the other side of the wall defining the bar hole engage the post and limit movement therealong). Thus it usually requires two handles to lift a heavy plate off the post.

However, when the weight plate 660 of FIG. 18A is removed from a weight rack, the bearing 720 provides a preselected range of motion (i.e. 15 to 30 degrees in either direction), allowing the weight plate to pivot with respect to the post without binding. This reduces binding and increases the speed of racking or unracking the weight plate 10. FIG. 18A also shows the hand hold 26 extending through the plate.

FIG. 18B shows another view of the weight plate 660 of FIG. 18A. The weight plate 660 may be equipped with one or more handles 26 to improve handling and grip when moving the weight plate 660. As shown, the bar hole 664 extends through the bearing so that the bearing is the only part of the weight which actually engages the rack post. The bar hole 664 may be coated by a film 714 adapted to provide improved friction characteristics. For example, the film may provide a low friction coefficient, allowing the weight plate 660 to be more easily racked or taken off a rack.

Also shown is the collar 716 and fasteners 708 which hold the bearing 720 in the void in the weight plate. The insert 700 may be formed from 4 pieces as shown in FIG. 18A, or may be formed as to pieces as shown in FIG. 18C. (A single piece insert—plus a bearing) could also be used. FIG. 18C illustrates a side view perspective of two piece inserts 700 and collars 716 with the weight omitted.

Figure 18D:
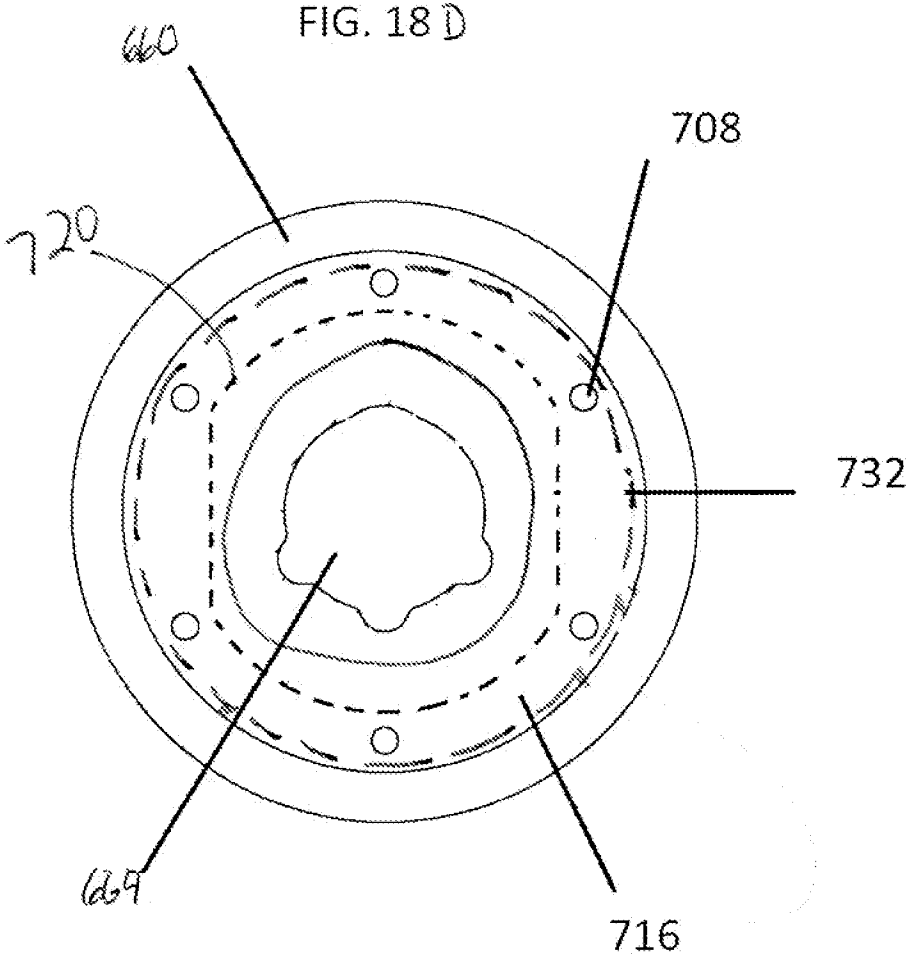
FIG. 18D shows a front view of the insert of FIG. 18C.
Figure 18C:
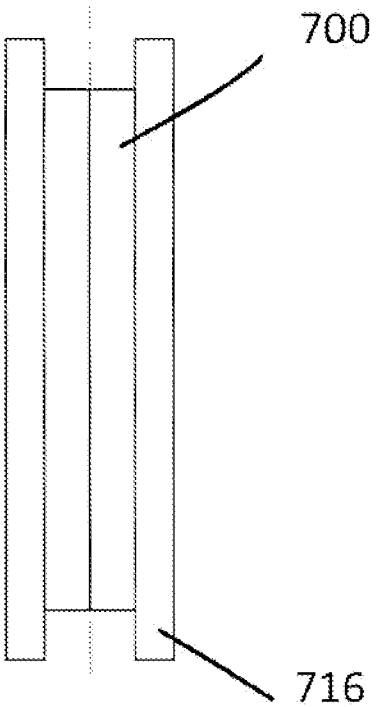
FIG. 18C shows a side view of an insert.

FIG. 18D displays a view of a small weight plate 10 and a collar 716, attached with fasteners 708. Also illustrated is the center socket (long dashed lines 732) that was drilled, stamped, or hollowed out of the weight plate 660 in order to install the inserts 700 (not visible) and collars 716.

Also shown by the short dashed lines is the exterior of the bearing 720. As shown by the short dashed line, the bearing 720 may not be circular. This prevents the bearing 720 from rotating within the insert 700.

As shown in FIG. 18D, the bearing defines a bar hole 664 which is shaped to selectively receive a post in the manner discussed with respect to FIGS. 1-16 above. Thus, this mechanism can be used in accordance with those aspects of the invention discussed above. An existing weight could be bored out to receive the inserts 700 or the inserts could be used with a barbell or dumbbell having a smaller diameter than that normally used with that weight.

According to one method, a user may select a weight plate they wish to use for an exercise. After the user is finished with the weight plate, the user may locate the correct keyed rack post on the weight rack for the particular sized weight plate. The user may then place the loading rest recess of the weight plate on the loading rest rod of the correct keyed rack post. This placement of the loading rest recess on the loading rest rod will ensure that the racking recesses are in alignment with the racking projections, without any further need for the user to adjust or rotate the weight plate relative to the rack post. After placement of the weight plate on the loading rest rod, the user then slides the weight distally toward the center of the weight rack. If by chance the user tries to place the weight plate on the incorrect post, the user will not be able to slide the weight plate onto the incorrect post, because the racking recesses of the weight plate would not be in alignment with the racking projections of the keyed rack post, thus preventing misplacement of the weight plates.

Furthermore it will be appreciated that other inventions are hereby disclosed. While the present application shows several different representative configurations, the invention may be embodied in other forms without departure from the spirit and essential characteristics thereof. The embodiments described therefore are to be considered in all respects as illustrative and not restrictive. Although the present invention has been described in terms of certain presently preferred embodiments, other embodiments that are apparent to those of ordinary skill in the art are also within the scope of the invention. Accordingly, it is not intended that the invention be limited, except as by the appended claims.

It will be appreciated that the present invention includes multiple different configurations and applications. For example, the present invention may include a system for managing weight plates including one or more of the following elements: a plurality of weight plates, the plurality of weight plates including at least one first weight plate having a first weight, and at least one second weight having a second weight, the at least one second weight being different from the first weight; a bar hole including at least one racking recess, wherein at least one of the size or location of the racking recess varies from one size weight plate to another, and the bar hole further comprising a loading rest recess; a weight rack, the weight rack comprising at least one first keyed rack post, and at least one second keyed rack post, the second keyed rack post being different from the first keyed rack post; a base portion, the base portion having at least one racking projection, and a loading rest rod extending horizontally from the base portion.

The system may also include the racking recess varying in size from one size weight plate to another; the racking recess varying in shape from one size weight plate to another; the racking recess varying in placement from one size weight plate to another; the at least one racking recess comprising two racking recesses; each weight plate of the set includes a center, and wherein the two racking recesses are spaced apart equally from the center of the each weight plate; the base portion further comprises a lower central portion with a first circumference, and an upper portion with a second circumference, the second circumference being smaller than the first circumference, and wherein the loading rest rod has a circumference equal to the second circumference; and/or the at least one racking projection having two racking projections, or combinations thereof.

The invention may also include a system for storing weight plates of various sizes, including one or more of: at least a first weight plate having a first weight and a second weight plate having a second weight, the second weight being different from the first weight, wherein each of the first weight plate and second weight plate have a bar hole including at least one racking recess, the placement of the racking recess varying from the first plate to the second plate, and the bar hole further comprising a loading rest recess; and at least a first weight rack post and second weight rack post for storing the plates, wherein the first post is different from the second post, and each post having a distal end for connection to a weight rack, a base portion having at least one racking projection, and a loading rest rod extending horizontally from the base portion The invention may also include: the placement of the at least one racking projection varying from the first post to the second post; the base portion having a lower central portion for receiving a bar hole and an upper portion for receiving a loading rest recess; the base portion having a first circumference and the loading rest rod has a second circumference, the second circumference being smaller than the first circumference; the at least one racking recess having two racking recesses; and/or the at least one racking recess of the first plate being configured to receive the at least one racking projection of the first post, and wherein the at least one racking recess of the second place is configured to receive the at least one racking projection of the second post, or combinations thereof.

The invention also includes a method for storing weight plates in an organized fashion, which may include one or more of: providing a set of weight plates, the set comprising at least one first weight plate having a first weight, and at least one second weight plate having a second weight, the at least one second weight being different from the first weight; each plate having a bar hole including at least one racking recess, wherein the racking recess varies from one size weight plate to another, and the bar hole further comprising a loading rest recess; providing a weight rack, the weight rack comprising at least one first keyed rack post, and at least one second keyed rack post, the second keyed rack post being different from the first keyed rack post; and each keyed rack post having a base portion, the base portion having at least one racking projection; and placing the loading rest recess of the first weight plate on the loading rest rod of the first keyed rack post, and sliding the first weight plate distally such that the at least one racking recess of the first weight plate receives the at least one racking projection of the first keyed rack post.

The method may further include the post having a loading rest rod extending horizontally from the base portion; and/or placing the loading rest recess of the second weight plate on the loading rest rod of the second keyed rack post, and sliding the second weight plate distally such that the at least one racking recess of the second weight plate receives the at least one racking projection of the second keyed rack post.

The present invention may also include a free weight having a mass/weight and a bar hole disposed generally in the center of the mass, the bar hole having a primary diameter and at least one racking recess extending beyond the primary diameter and a loading rest recess extending beyond the primary diameter. The free weight plate may also be part of a system wherein the free weight plate is a first free weight plate and further comprising a second free weight, the second free weight plate having a mass which is different than the mass of the first free weight plate, the second free weight plate having a bar hole having a primary diameter and at least one racking recess extending beyond the primary diameter of the second free weight plate and a loading rest recess extending beyond the primary diameter of the second free weight plate, and wherein the at least one racking recess of the second free weight plate is in a different orientation relative to the loading rest recess of the second free weight plate than the at least one racking recess of the first free weight plate is to the at least one racking recess of the second free weight plate.

Moreover, the free weight system may include a third free weight plate, the third free weight plate having a mass or weight which is different than the mass or weight of the first free weight plate and is different than the mass or weight of the second free weight plate, and wherein the third free weight plate has a bar hole having a primary diameter, at least one racking recess extending from the bar hole beyond the primary diameter and a loading rest recess extending from the bar hole beyond the primary diameter, and wherein the orientation between the at least one racking recess of the third free weight plate and the loading rest recess of the third free weight plate is different than the orientation between the at least one racking recess of the first free weight plate and the loading rest recess of the first free weight plate, and wherein the orientation between the at least one racking recess of the third free weight plate and the loading rest recess of the third free weight plate is different than the orientation between the at least one racking recess of the second free weight plate and the loading rest recess of the second free weight plate.

Likewise the invention may include a weight rack having at least one keyed rack post having a base portion having a first diameter and at least one projection extending outwardly along a side thereof and loading rest rod having a second diameter, smaller than the first diameter, the loading rest rod extending from an end of the base portion The invention may further include taking an existing weight plate, enlarging the bar hole by cutting, grinding, etc., and placing an insert into enlarged hole. The insert may have a bar hole formed therein which includes recesses, or may housing a bearing which includes recesses for limiting which weight rack post the weight will slide onto.

Thus there is disclosed a free weight, post, system and method of use which addresses issues relating to the use of free weight plates. It will be appreciated that modifications may be made within the ordinary skill in the art and the appended claims are intended to cover such modifications.

What is claimed is:

1. A system for managing weight plates, the system comprising:

a plurality of weight plates, the plurality of weight plates including at least one first weight plate having a first weight, and at least one second weight plate having a second weight, the second weight being different from the first weight, and wherein each weight plate comprises:

a bar hole having a primary portion having a first cross-sectional area configured to receive an end of a barbell, and at least one racking recess having a second cross-sectional area extending from the primary portion of the bar hole, wherein at least one of the size, shape and location of the at least one racking recess varies depending on a weight of the weight plate; and a weight rack, the weight rack comprising a plurality of rack posts and each rack post of the plurality of rack posts having at least one racking projection for disposition in the at least one racking recess of the bar hole of one weight plate, but wherein the racking projection of the rack post will not align with or be received in the recess of another weight plate.

2. The system of claim 1, wherein each rack post of the plurality of rack posts comprises:

a base portion, the base portion having at least one racking projection sized and shaped to be inserted into the primary portion and at least one racking recess, and a loading rest rod extending generally horizontally from the base portion.

3. A system for managing weight plates, the system comprising:

a plurality of weight plates, the plurality of weight plates including at least one first weight plate having a first weight, and at least one second weight plate having a second weight, the second weight being different from the first weight, and wherein each weight plate comprises:

a bar hole having a primary portion configured to receive an end of a barbell and at least one recess extending from the primary portion of the bar hole, wherein at least one of the size, shape and location of the at least one recess varies depending on a weight of the weight plate; and a weight rack, the weight rack comprising a plurality of rack posts and each rack post of the plurality of rack posts having at least one racking projection for disposition in the at least one recess of the bar hole of one weight plate, but wherein the racking projection of the rack post will not be received in the recess of another weight plate, each rack post having a base portion, the base portion having at least one racking projection, and a loading rest rod extending generally horizontally from the base portion; and wherein the bar hole has a loading rest recess and wherein the weight plate will align itself for advancement back onto the base portion of a select rack post when the loading rest rod is disposed in the loading rest recess.

4. The system for managing weight plates according to claim 1, wherein the racking recesses in the weight plates vary in size depending on a weight of the weight plate.

5. The system for managing weight plates according to claim 1, wherein the racking recess varies in shape depending on a weight of the weight plate.

6. The system for managing weight plates according to claim 1, wherein the racking recess varies in placement depending on a weight of the weight plate.

7. The system for managing weight plates according to claim 6, wherein the at least one racking recess comprises two racking recesses.

8. The system for managing weight plates according to claim 7, wherein each weight plate includes a center, and wherein the two racking recesses are spaced apart equally from the center of each weight plate.

9. A system for managing weight plates, the system comprising:

a plurality of weight plates, the plurality of weight plates including at least one first weight plate having a first weight, and at least one second weight plate having a second weight, the second weight being different from the first weight, and wherein each weight plate comprises:

a bar hole having a primary portion configured to receive an end of a barbell, and at least one recess extending from the primary portion of the bar hole, wherein at least one of the size, shape and location of the at least one recess varies depending on a weight of the weight plate; and a weight rack, the weight rack comprising a plurality of rack posts and each rack post of the plurality of rack posts having at least one rod or projection for disposition in the at least one recess of the bar hole of one weight plate, but wherein the rod or projection of the rack post will not be received in the recess of another weight plate, each rack post having a base portion, the base portion having at least one racking projection, and a loading rest rod extending generally horizontally from the base portion; and wherein the base portion further comprises a lower central portion with a first circumference, and an upper portion with a second circumference, the second circumference being smaller than the first circumference, and wherein the loading rest rod has a circumference equal to the second circumference.

10. The system for managing weight plates according to claim 7, wherein the at least one racking projection comprises two racking projections extending along the sides of the rack post.

11. The system for managing weight plates of claim 1, wherein the at least one first weight plate has a void formed therein and further comprising an insert disposed in the void and the bar hole is formed in the insert.

12. The system for managing weight plates of claim 1, further comprising a bearing disposed in at least one select weight plate of the plurality of weight plates, and wherein the bar hole is formed in the bearing.

13. The system for managing weight plates of claim 12, wherein the bearing is tiltable relative to the at least one select weight plate such the at least one select weight plate may tilt relative to the barbell when the insert is disposed on the barbell independent of rotation about the barbell.

14. A weight rack configured for receiving at least one weight plate, the weight rack comprising at least one keyed rack post having a base portion having a first end and a second end, the base portion having a first cross-sectional area and at least one projection extending outwardly along a side of the base portion and a loading rest rod having a first end and a second end, the loading rest rod having a second cross-sectional area, smaller than the first cross-sectional area, the second end of the loading rest rod extending beyond the second end of the base, and wherein the loading rest rod extends along at least a part of the side of the base portion.

15. The weight rack according to claim 14, wherein the at least one keyed rack post includes a first keyed rack post and wherein the at least one projection extending outwardly along a side of the base portion of the first keyed rack post extends along one side of the base portion.

16. The weight rack according to claim 15, further comprising a second keyed rack post having a base portion and a projection extending along a side of the base portion at a location, and wherein the location of the projection on the second keyed rack post is different than the location of the projection on the first keyed rack post radially about the base portion.

17. The weight rack according to claim 15, further comprising a second keyed rack post having a loading rest rod and wherein the loading rest rod of the second keyed rack post is a different shape than the loading rest rod of the first keyed rack post.

18. A free weight comprising a free weight plate having a front face and a rear face and having a void extending therethrough from the front face to the rear face and an insert disposed in the void, the insert having a bar hole disposed therein, the insert being tiltable relative to a face of the plate.

19. The system of claim 2, wherein the base portion of at least one rack post has a first cross-sectional area and wherein the loading rest rod of said at least one rack post has a second cross-sectional area which is smaller than the first cross-sectional area.

20. The system of claim 2, wherein at least one rack post is keyed to limit which weight plate can be advanced onto the base portion of said at least one rack post.

21. The weight rack of claim 14, wherein the weight rack has a center stand, the base portion extending from the center stand and the loading rest rod extending from the base portion opposite the center stand.

22. The weight rack of claim 14, wherein base portion has a longitudinal axis and wherein the at least one projection extends generally parallel to the longitudinal axis of the base portion.

23. The weight rack of claim 14, wherein the base portion has a cross-sectional area having a first shape and wherein the loading rest rod has a cross-sectional area having a second shape different from the first shape.

24. The free weight of claim 18, wherein the insert comprises a bearing tiltable relative to a face of the free weight plate, such that the free weight plate may tilt toward a bar passing through the bearing.

25. The free weight of claim 18, wherein the insert includes a non-circular bar hole having a primary portion and a recess open to and extending away from the primary portion.

* * * * *